US011235968B2

(12) United States Patent
Merrill

(10) Patent No.: US 11,235,968 B2
(45) Date of Patent: Feb. 1, 2022

(54) HORSE BRIDLE BIT

(71) Applicant: Neil Merrill, Axtell, UT (US)

(72) Inventor: Neil Merrill, Axtell, UT (US)

( * ) Notice: Subject to any disclaimer, the term of this patent is extended or adjusted under 35 U.S.C. 154(b) by 117 days.

(21) Appl. No.: 16/704,288

(22) Filed: Dec. 5, 2019

(65) Prior Publication Data

US 2021/0171336 A1 Jun. 10, 2021

(51) Int. Cl.
*B68B 1/06* (2006.01)

(52) U.S. Cl.
CPC ..... *B68B 1/06* (2013.01)

(58) Field of Classification Search
CPC .... B68B 1/04; B68B 1/06; B68B 5/00; B68B 5/06; B68B 99/00
USPC ..... 54/7–9, 6.1, 6.2
See application file for complete search history.

(56) References Cited

U.S. PATENT DOCUMENTS

| | | | | |
|---|---|---|---|---|
| 126,704 A | | 5/1872 | Huie | |
| 2,041,620 A | * | 5/1936 | Stephens | B68B 1/06 54/6.1 |
| 2,494,201 A | * | 1/1950 | Ray | B68B 1/06 54/7 |
| 2,940,238 A | | 6/1960 | Poole | |
| 3,318,069 A | | 5/1967 | Cunard | |
| 3,670,476 A | * | 6/1972 | Parry | B68B 1/06 54/8 |
| 6,105,346 A | * | 8/2000 | Hsi-Chang | B68B 1/06 54/8 |

FOREIGN PATENT DOCUMENTS

| | | | | |
|---|---|---|---|---|
| DE | 142305 | | 5/1902 | |
| FR | 429039 | | 9/1911 | |
| GB | 458930 A | * | 12/1936 | B68B 1/04 |
| GB | 519279 A | * | 3/1940 | B68B 1/04 |

* cited by examiner

*Primary Examiner* — David J Parsley
*Assistant Examiner* — Danielle A Clerkley
(74) *Attorney, Agent, or Firm* — Bretton L. Crockett; TechLaw Ventures, PLLC

(57) ABSTRACT

The disclosure of the present invention relates to a HORSE BRIDLE BIT or more specifically to a horse bridle bit where the purchase portion of the side shank includes an articulated headstall ring and an articulated curb chain ring allowing the side shank to conform to the side of the horse's cheek or jaw. A less intrusive bit allows for improved rider control and a more comfortable and predicable horse.

10 Claims, 4 Drawing Sheets

HORSE BRIDLE BIT

CROSS-REFERENCE TO RELATED APPLICATIONS

This application is related to U.S. application Ser. No. 16/565,411, filed Sep. 9, 2019, entitled TOP RING RELIEF JOINT FOR A HORSE BRIDLE BIT AND METHOD OF USE and which application is hereby incorporated by reference herein in its entirety, including but not limited to those portions that specifically appear hereinafter, the incorporation by reference being made with the following exception: In the event that any portion of the above-referenced applications is inconsistent with this application, this application supersedes said portion of said above-referenced applications.

SUMMARY OF THE INVENTION

The disclosure of the present invention relates to a HORSE BRIDLE BIT or more specifically to a horse bridle bit having a headstall ring and curb chain ring featuring adjustable relief joints which allows the upper portion of the side shanks to conform to the cheek of the horse during aggressive rein commands, such as, turn or whoa. The relief joints allow for self-adjustment of the headstall ring and curb attachment ring to provide even contact and distribution of pressure against the side of the horses cheek and chin, depending on the position of the bit throughout the range of motion as the bit rotates and/or tips. A bit without the relief joints can cause undue pressure on different spots of the horse's face, depending on the bit position, and as the contoured shape of the horse's head changes from the chin and through the cheek area. Additionally, each horse may have differing facial characteristic or prominent contours which may be better accommodated using a bit having a relief joints at the headstall ring and curb chain ring. The bridle bit configured to convey clear commands to the horse without undue encroachment into the cheek or jaw, resulting in more controllable and compliant horse.

A first embodiment of the present invention or horse bridle bit comprising a mouthpiece and side shanks connected with a moveable joint. The full side shanks having an overall length, with approximately two-thirds of the length being substantially linear with a rein loop formed in the free-end, the shank having an approximately 45 degree downturn bend where the remaining one-third of the shank forms a purchase portion; the free end of the purchase portion having an articulated headstall ring and articulated curb chain ring.

The headstall ring configured as substantially a semi-circle wherein approximately one half of the central axis of the semi-circle base formed having a solid panel which extends toward the upper quadrant of the semi-circular ring opening. The base of the solid panel has an opening or pivot cut-out formed in the base, the cut-out leaving enough material at the base to constitute an axle or pivot pin, the pivot pin forming the base of semi-circular headstall ring. A post is formed at the inside edge of the pivot opening, and the post is attached to the axle or pivot pin proximate the mid-point of the headstall ring base. The axle or pivot pin extends across the headstall ring base from the panel side to the open side with the pivot opening post attached at the mid-point of the headstall ring base, at the mid-point of the pivot pin.

The headstall ring is attached to the purchase portion of the side shank with pin cylinder formed in the free end of the purchase portion. The cylinder is aligned at approximately forty five degrees from purchase portion and perpendicular to, or substantially perpendicular to the linear rein loop end of the side shank. The cylinder having a central opening or hole formed to fit over the headstall ring pivot pin with enough clearance to allow the head stall ring to move freely. A limit slot is formed in the outside edge of the pin cylinder, the limit slot is formed wider than the thickness of the headstall ring and configured to engage a portion of the solid panel formed on the inside of the headstall ring. The width of the slot can be adjusted to change of the amount of rotation, or relief, the headstall ring has in relationship to the longitudinal axis of the side shank. In one embodiment, the limit slot will allow the headstall ring to pivot approximately 15 degrees to the outside of the side shank axis and approximately 15 degree to the inside of the side shank axis; this may also be described as the headstall ring having an overall relief rotation of 30 degrees. In other embodiments the cylinder limit slot will allow the headstall ring to having an overall relief rotation of more than 30 degrees or less than 30 degrees. In another embodiment the degrees of headstall relief or rotation to the inside of the side shank does not equal the degrees of rotation the headstall ring to the outside of the side shank.

It is understood that in no case will the headstall ring be allowed to rotate more than 90 degree toward the inside of the side shank which may cause the edge of the side shank to be pulled or gouge into the horse's cheek or jaw. The overall rotation of the headstall ring will not reach 180 degrees, but, as for this disclosure, it is understood that be overall rotation or relief of the headstall ring may be any overall degree of rotation less than 180 degrees.

The curb chain ring is configured having a pivot cylinder formed in one end and the free end having a curb chain opening or a curb chain hook. The pivot cylinder is configured to fit over the pivot pin formed in the base of the headstall ring on the open side, opposite the solid panel. The pivot cylinder having a central opening, or hole, formed to fit securely over the headstall ring pivot pin, the hole having enough clearance to allow the curb chain ring to pivot freely. A curb chain ring limit slot is formed on the inside edge of the curb chain cylinder with the limit slot formed to fit over the central post of the headstall ring. The width of the curb chain cylinder limit slot can be adjusted to change the amount of the relief provided by the curb chain ring. In one embodiment, the limit slot will allow the curb chain ring to pivot approximately 15 degrees to the outside of the alignment of the headstall ring and approximately 15 degree to the inside of the alignment of the headstall ring; this may also be described as the curb chain ring having an overall relief rotation of 30 degrees in relationship to the headstall ring. In other embodiments the cylinder limit slot will allow the curb chain ring to having an overall relief rotation of more than 30 degrees or less than 30 degrees and in no case may the curb chain ring rotate more than 90 degrees toward the inside of the side shank where may cause the horse discomfort.

In one embodiment, the curb chain ring is formed as a ring requiring the curb chain to have attachment hardware to close or secure the bridle bit on the horse's head. In another embodiment, the curb chain ring is formed as a hook, or as a carabiner having a spring gate closure. This embodiment allows a full curb chain link or ring to be pushed through the spring gate and secured within the curb chain ring. The spring gate, in conjunction with the ability to pivot the curb chain ring away from the horse's head, allows a rider or user to readily adjust the curb chain length while the horse is wearing the bridle bit.

BRIEF DESCRIPTION OF DRAWINGS

The following description of the embodiments can be understood in light of the Figures which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals or word descriptions in different drawings represent the same element, and thus their descriptions may be omitted.

DETAILED DESCRIPTION OF DRAWINGS

Figure 1:
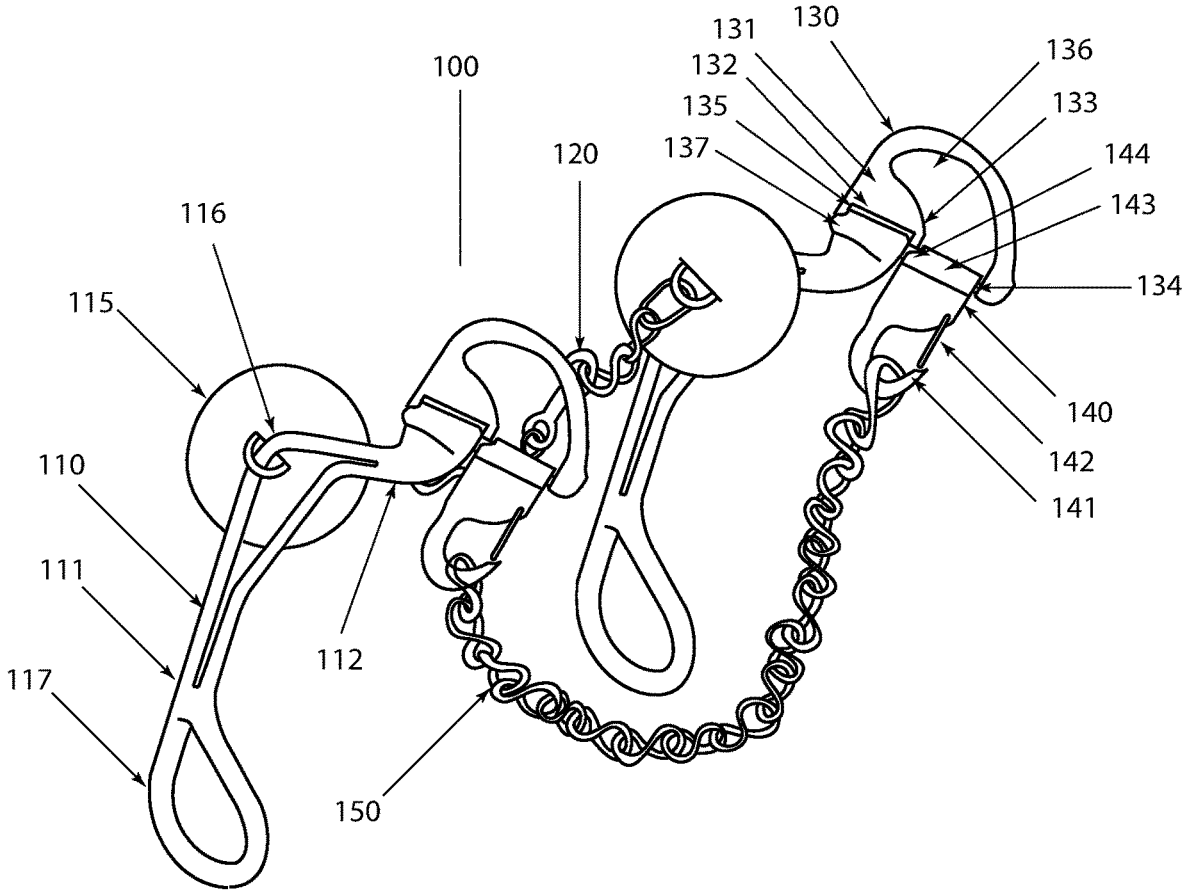
FIG. 1, a perspective view of a horse bridle bit.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

The present invention will be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

Figure 2:
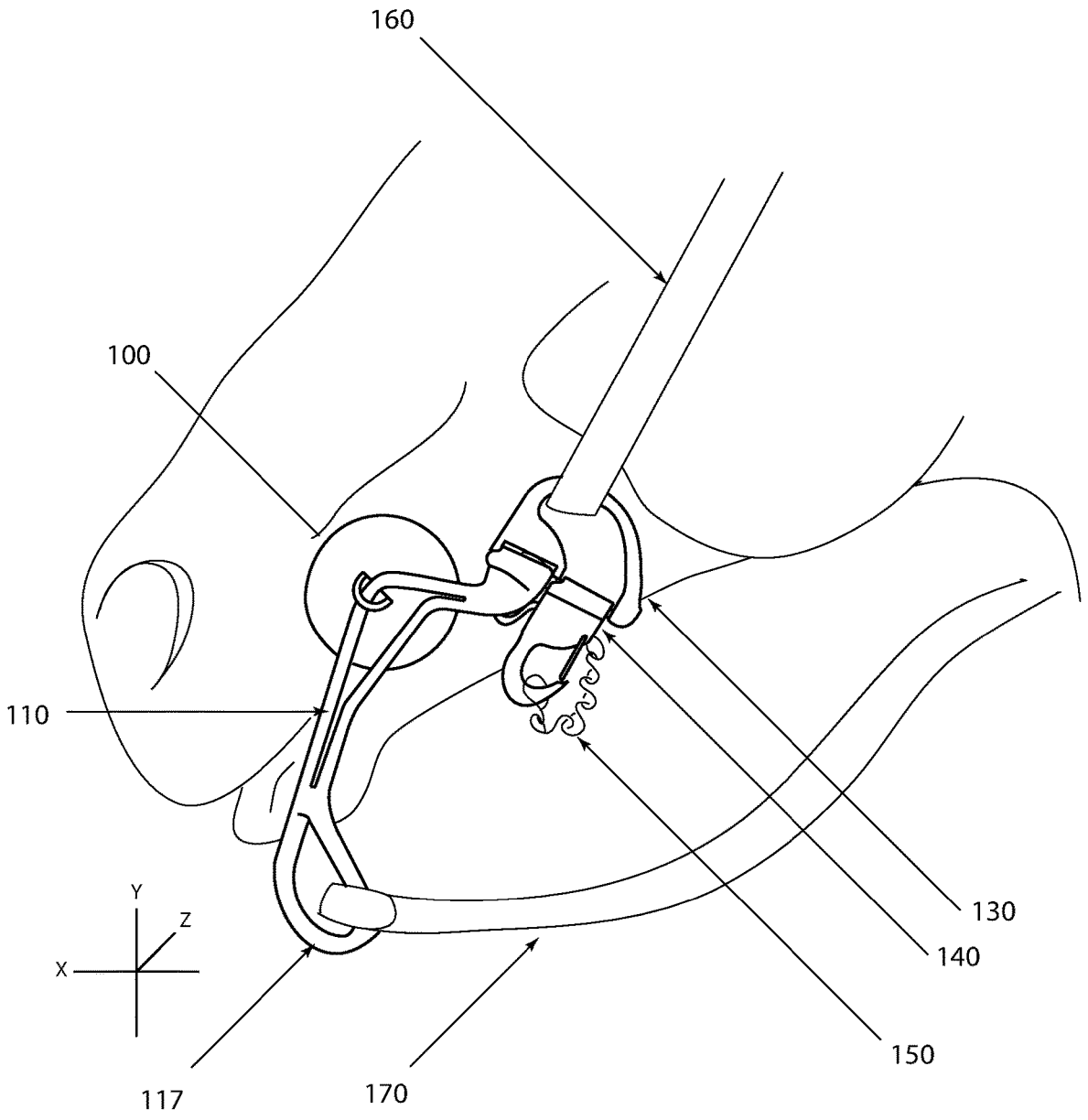
FIG. 2, a single side view of a horse bridle bit in place.

A first embodiment of the present invention, or horse bridle bit 100, shown in FIGS. 1 and 2, including side shanks 110 having a mouthpiece 120 attached to the side shank 110 at a moveable side shank joint 116. A pinch shield 115 can be install at the moveable side shank joint 116 in order to protect the mouth and lips of the horse. The side shank 110 includes a shank portion 111 having a rein ring 117 and purchase portion 112. A pivot cylinder 137 is formed at the free end of the purchase portion 112, the pivot cylinder 137 aligned at 45 degrees from the main axis of the purchase portion 112, and is aligned substantially perpendicular to the main axis of the shank portion 111. A limit slot 135 is formed in the outside edge of the pivot cylinder 137; the limit slot having a width configured to accommodate the thickness of the headstall ring 130.

An articulated headstall ring 130 is configured to be fit onto the pivot cylinder 137 of the side shank purchase portion 112. The headstall ring 130 is formed substantially as a semi-circle with an arcuate top portion and a substantially linear base portion. A solid panel 131 is formed on the outside half the linear base of the headstall ring 130 and slopes upward toward the outside upper quadrant of the headstall ring 130, a ring opening 136 is formed in the remaining area of the headstall ring 130. A substantially rectangular pivot cut-out 132 is formed at the base of the solid panel 131 with a portion of the material reserved along the base to form a pivot pin or axle 134. The pivot pin 134 ultimately extending the full length of the headstall ring 130 base from the solid panel 131 side to the open ring 136 side of the headstall ring 130. A post 133 is formed at the inside edge of the solid panel 131 and the opening formed by the pivot cut-out 132.

The pivot pin or axle 134 for the headstall ring 130 is configured to pass through the pivot pin cylinder 137 formed in the end of the purchase portion 112 and create an articulated relief joint for the headstall ring 130. The relief joint used to allows the headstall ring 130 to pivot and lay flat against a horse's cheek or face when the horse bridle bit 100 is aggressively manipulated. The width of the pivot pin limit slot 135 can be adjusted wider to allow for a more open or more flexible relief joint or the pivot pin limit slot 135 can be narrowed to create a more aggressive horse bridle bit 100.

The curb chain ring 140 is configured as a substantially semi-circular ring or hook which pivots at base and having the rounded portion facing in a direction substantially opposite to the direction of the rounded portion of the headstall ring 130. The curb chain ring 140 having a curb chain pivot cylinder 143 formed along the base portion of the semi-circle, the pivot cylinder 143 having a central hole formed having a diameter slightly larger than the diameter of the pivot pin or axle 134 and the pivot cylinder 143 having a width to fit into the open portion of the headstall ring 130 base. A curb chain ring limit slot 144 formed having a width which is slightly wider than the formed thickness of the post 133 formed at the base of the head stall ring 130. The width of the limit slot 144 can vary in order to change the amount of curb chain ring 140 articulation. The curb chain ring 140 having the rounded portion opposite the base forming a hook 141 and using a spring gate 142 in order to retain the curb chain 150 within the hook 141.

The horse bit 100 of the present invention is shown in place in on horse 500 in FIG. 2; including the reins 170, head stall 160 and curb chain 150.

Figure 3:
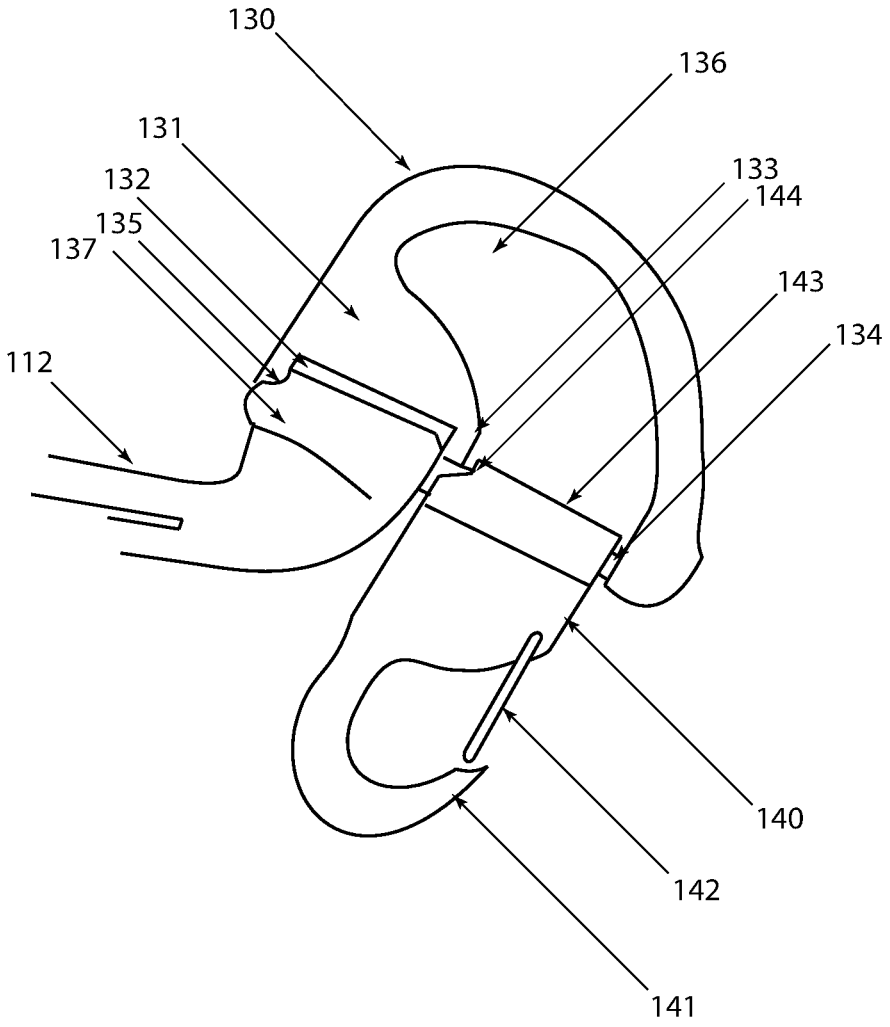
FIG. 3, a detail view of a horse bridle bit articulating top ring and curb ring, and, FIG. 4A-4C, are top views of the horse bridle bit showing articulation of the top ring and curb chain ring.

FIG. 3 details the articulation points of the free end of the purchase portion 112 of the side shank 110. A pivot cylinder 137 is formed at the free end of the purchase portion 112. A limit slot 135 is formed in the outside edge of the pivot cylinder 137. The limit slot having a width configured to accommodate the thickness of the headstall ring 130.

A headstall ring 130 is configured to be fit onto the pivot cylinder 137 of the side shank purchase portion 112. The headstall ring 130 is formed substantially as a semi-circle with an arcuate top portion and a substantially linear base portion. A solid panel 131 is formed on the outside half the linear base of the headstall ring 130 and slopes upward toward the outside upper quadrant of the headstall ring 130, a ring opening 136 is formed in the remaining area of the headstall ring 130. A substantially rectangular pivot cut-out 132 is formed at the base of the solid panel 131 with a portion of the material reserved along the base to form a pivot pin or axle 134. The pivot pin 134 extends the full length of the headstall ring 130 base from the solid panel 131 side to the open ring 136 side of the headstall ring 130. A post 133 is formed at the inside edge of the solid panel 131 and the opening formed by the pivot cut-out 132.

The pivot pin or axle 134 for the headstall ring 130 is configured to pass through the pivot pin cylinder 137 formed in the end of the purchase portion 112 and create an articulated relief joint for the headstall ring 130. The relief joint used to allows the headstall ring 130 to pivot and lay flat against a horse's cheek or jaw when the horse bridle bit 100 is manipulated. The width of the pivot pin limit slot 135 can be adjusted wider to allow for a more open or more flexible relief joint or the pivot pin limit slot 135 can be narrowed to create a more aggressive horse bridle bit 100.

The curb chain ring 140 is configured as a substantially semi-circular ring or hook which pivots at a planer base and having the rounded portion facing in a direction substantially opposite to the direction of the rounded portion of the headstall ring 130. The curb chain ring 140 having a curb chain pivot cylinder 143 formed along the base portion of the semi-circle, the pivot cylinder 143 having a central hole formed having a diameter slightly larger than the diameter of the pivot pin or axle 134 and the pivot cylinder 143 having a width to fit into the open portion of the headstall ring 130 base. A curb chain ring limit slot 144 formed having a width which is slightly wider than the formed thickness of the post 133 formed at the base of the head stall ring 130. The width of the limit slot 144 can vary in order to change the amount of curb chain ring 140 articulation. The curb chain ring 140 having the rounded portion opposite the base forming a hook 141 and using a spring gate 142 in order to retain the curb chain within the hook 141. The spring gate 142 may be configured having a solid spring loaded bar or may be configured as a wire loop formed having two off-set ends attached proximate the base portion of the curb chain ring 140. The fixed off-set ends of the spring gate 142 creating bias towards the point of the curb chain hook 141 and securing the spring gate 142 in a closed position.

Figure 4A:
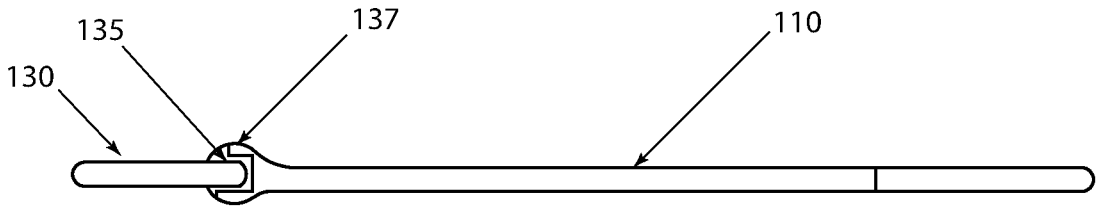
Figure 4B:
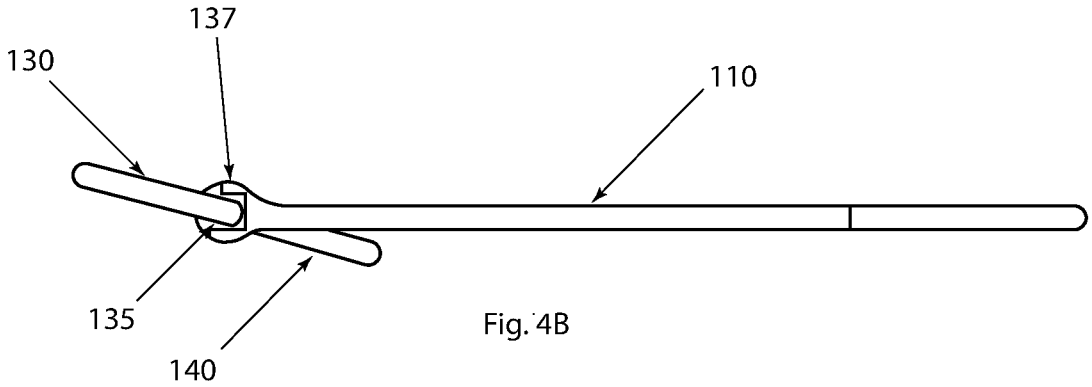
Figure 4C:
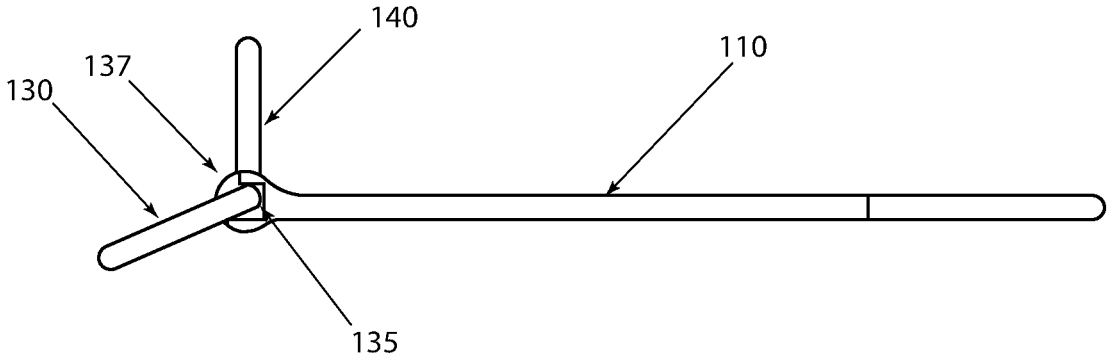

FIGS. 4A-4C illustrate the articulation of the headstall ring 130 and the curb chain ring 140 in relationship to the side shank 110 of the horse bridle bit 100. As seen from a top view, a pivot pin cylinder 137 is formed at the free end of the purchase portion 111 of the side shank 110, the pivot cylinder 137 having a central hole configured to allow the pivot pin or axle of the head stall ring 130 fit through while still allowing rotation or articulation at the joint. A limit slot 135 is formed at top portion of the pivot cylinder 137, the limit slot 135 having a width slightly wider than the thickness of the headstall ring 130. The width of the limit slot 135 can be adjusted to control the amount of articulation of the headstall ring 130. A similar limit slot arrangement is made for curb chain ring 140 but is not shown in the top views of FIGS. 4A-4C.

As shown in FIG. 4A; headstall ring 130 is in alignment with the side shank 110 and is centered in the limit slot 135. The curb chain 140 is aligned directly beneath the headstall ring 130 and is not visible in FIG. 4A.

FIGS. 4B and 4C show two possible configurations of the headstall ring 130 and the curb chain ring 140 in relationship to the side shank 110. In FIG. 4B, the headstall ring 130 is articulated in a first direction, in a line approximately 15 degrees of the main axis of the side shank 110, and the curb chain ring 140 is articulated in direction opposite the headstall ring. The illustration of FIG. 4C shows the headstall ring 130 and curb chain ring 140 articulated in the same direction.

The invention claimed is:

1. A bridle bit comprising;
- a pair of side shanks,
  - each of the side shanks including,
    - a shank portion,
      - a free end of the shank portion having a rein ring,
    - an offset purchase portion,
      - a free end of the purchase portion having,
        - an articulated headstall ring;
- a pivot cylinder formed at the free end of the purchase portion,
  - the pivot cylinder comprising,
    - a central hole,
    - a limit slot,
      - the headstall ring comprising,
        - a thickness narrower than the width of the limit slot formed in the pivot cylinder of the purchase portion,
      - an arcuate top portion,
      - a linear base,
      - a panel formed in a lower quadrant of the headstall ring,
        - a pivot cut-out formed in the panel,
          - the pivot cut-out having a residual outside portion, an inside post and a base of the pivot cut-out forming an axle,
            - the axle extending across the linear base,
            - a portion of the axle within the pivot cut-out extending through the central hole of the pivot cylinder,
    - a curb chain ring formed comprising,
      - an arcuate ring portion formed as a hook,
      - a linear base forming a pivot cylinder,
        - the pivot cylinder comprising,
          - a central hole,
          - a limit slot, and,
      - the central hole of the curb chain ring pivot cylinder configured to moveably fit over the headstall ring axle with the inside post of the headstall ring pivot cut-out captured within the limit slot of the curb-chain ring pivot cylinder.

2. The bridle bit of claim 1, including a spring gate installed over a gap formed at an opening of the curb chain ring hook.

3. The bridle bit of claim 2 wherein the spring gate is biased in a closed position.

4. The bridle bit of claim 1 wherein the limit slot formed in the pivot cylinder of the purchase portion allows the headstall ring to pivot 15 degrees in each direction around the headstall ring axle.

5. The bridle bit of claim 1 wherein the limit slot formed in the pivot cylinder of the purchase portion allows the headstall ring to pivot more than 15 degrees and less than 90 degrees in each direction around the headstall ring axle.

6. The bridle bit of claim 1 wherein the limit slot formed in the pivot cylinder of the curb chain ring allows the curb chain ring to pivot 15 degrees in each direction.

7. The bridle bit of claim 1 wherein the limit slot formed in the pivot cylinder of the curb chain ring allows the curb chain ring to pivot more than 15 degrees and less than 90 degrees in each direction around the headstall ring axle.

8. A method of using a horse bridle bit comprising;
- providing a pair of side shanks,
  - each of the side shanks including, a shank portion,
a free end of the shank portion having a rein ring,
an offset purchase portion,
a free end of the purchase portion having,
a pivot cylinder formed at the free end of the purchase portion,
the pivot cylinder comprising,
a central hole,
a limit slot,
a headstall ring comprising,
a thickness narrower than the width of the limit slot formed in the pivot cylinder of the purchase portion,
an arcuate top portion,
a linear base,
a panel formed in a lower quadrant of the headstall ring,
a pivot cut-out formed in the panel,
the pivot cut-out having a residual outside portion, an inside post and a base of the pivot cut-out forming an axle,
the axle extending across the linear base,
a portion of the axle within the pivot cut-out extending through the central hole of the pivot cylinder,
a curb chain ring formed comprising,
an arcuate ring portion formed as a hook,
a linear base forming a pivot cylinder,
the pivot cylinder comprising,
a central hole,
a limit slot having a width, and,
the central hole of the curb chain ring pivot cylinder configured to moveably fit over the headstall ring axle with the inside post of the headstall ring pivot cut-out captured within the limit slot of the curb-chain ring pivot cylinder.

9. The method of claim 8 comprising adjusting the width of the limit slot formed pivot cylinder at the free end of the purchase portion to change an articulation angle of the headstall ring.

10. The method of claim 8 comprising adjusting the width of the limit slot formed in the curb chain ring pivot cylinder to change an articulation angle of the curb chain ring.

* * * * *